United States Patent [19]

Chow et al.

[11] Patent Number: 4,516,954

[45] Date of Patent: May 14, 1985

[54] TOY VEHICLE

[75] Inventors: Kwong-Wai Chow, Kowloon; Alfred T. Y. Lau; Ming-Ngar Chow, both of Hong Kong, all of Hong Kong; James S. W. Lee, 4528 42nd St. Apt. 4A, Long Island, N.Y. 11104

[73] Assignee: James S. Lee, Long Island, N.Y.

[21] Appl. No.: 473,991

[22] Filed: Mar. 10, 1983

[30] Foreign Application Priority Data

Jan. 11, 1983 [GB] United Kingdom ..... 8300589

[51] Int. Cl.[3] ..... A63H 29/24

[52] U.S. Cl. ..... 446/461; 446/464

[58] Field of Search ..... 446/457, 459, 461, 462, 446/463, 464

[56] References Cited

U.S. PATENT DOCUMENTS 675,718 6/1901 Converse ..... 46/208
3,541,725 11/1970 Miura ..... 46/206
3,798,831 3/1974 Higashi ..... 446/464
3,938,278 2/1976 Nakamori ..... 446/461

FOREIGN PATENT DOCUMENTS 2109694 6/1983 United Kingdom ..... 46/209

*Primary Examiner*—Mickey Yu
*Attorney, Agent, or Firm*—Laff, Whitesel, Conte & Saret

[57] ABSTRACT

A toy vehicle has a gear box containing a clock spring which is wound by pushing the vehicle backward. A two part toggle-linkage system connects the gear box to the frame. When the clock spring is wound, the resulting spring bias urges the toggle-linkage system to one over center position which locks the gear box in order to preserve the energy stored in the wound spring. When the toggle-linkage system is pressed near its center, it moves over center to another position, which unlocks the gear box and releases the energy stored in the wound spring in order to propel the vehicle. When the vehicle is next moved backward, the toggle-linkage returns to the locked position which once again locks the gear box.

9 Claims, 8 Drawing Figures

TOY VEHICLE

This invention relates to toy vehicles, and more particularly, to toy vehicles which first store energy by being rolled in a backward direction, and which are then driven forward responsive to a release of the energy which is so stored.

There are toy vehicles which are adapted to store energy when they are rolled backward, in order to wind a spring. Usually, these vehicles are propelled in a forward direction by simply releasing them after they have been rolled backward. Examples of such toy vehicles are found in U.S. Pat. Nos. 4,077,156 (Asano) and 2,182,529 (Wyrick).

In each toy, there is a premium on realism. The more that a child can relate his toys to the "adult" world that he sees about him, the more he enjoys and learns from his play. Thus, a toy vehicle which merely plunges away when released is not always perceived as a vehicle which can be controlled. On the other hand, if a toy must be released by switches, levers, and the like, it is not likely to be perceived as an "adult" vehicle either. Moreover, it may be awkward and difficult for a child to get a finger under or around a small toy vehicle in order to work a lever (or the like) without simultaneously deflecting the vehicle from its path.

Accordingly, there is a need for new and improved vehicles which operate in the described manner, and which are controlled, at a touch. Here, an object is to provide such a controlled vehicle, which has no apparent and unrealistic control levers, switches, or the like.

Another object is to provide a reliable and dependable vehicle of the described type that is self adjusting, so that it does not have to be locked in the energy storage condition and unlocked to release the energy.

In keeping with an aspect of the invention, a toy vehicle has a gear box and a toggle-linkage system connected to the frame. The gear box contains a clock spring which is wound by pushing the vehicle backward. As the clock spring is wound, the toggle-linkage system is urged by the resulting spring tension to one over center position which locks the gear box to preserve the energy stored in the wound spring. When the toggle-linkage system is pressed downwardly, it moves over center to another position, which unlocks the gear box and releases the energy stored in the wound spring, in order to propel the vehicle. When the vehicle is next moved backward, the toggle-linkage returns to the position which locks the gear box.

A preferred embodiment of the invention is seen in the attached drawings, wherein.

Figure 1:
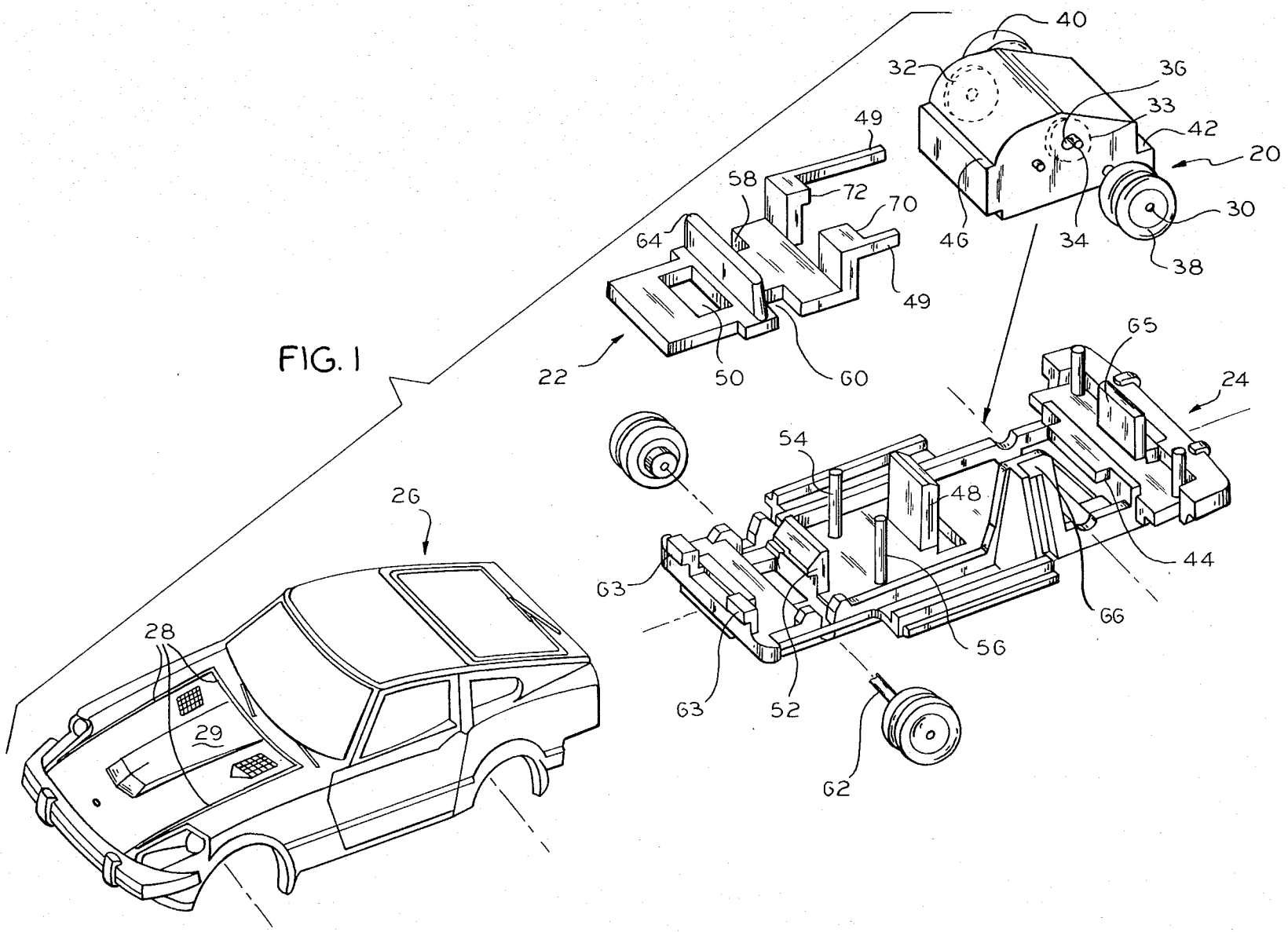
FIG. 1 is an exploded view (in perspective) of the inventive toy vehicle.
Figure 2:
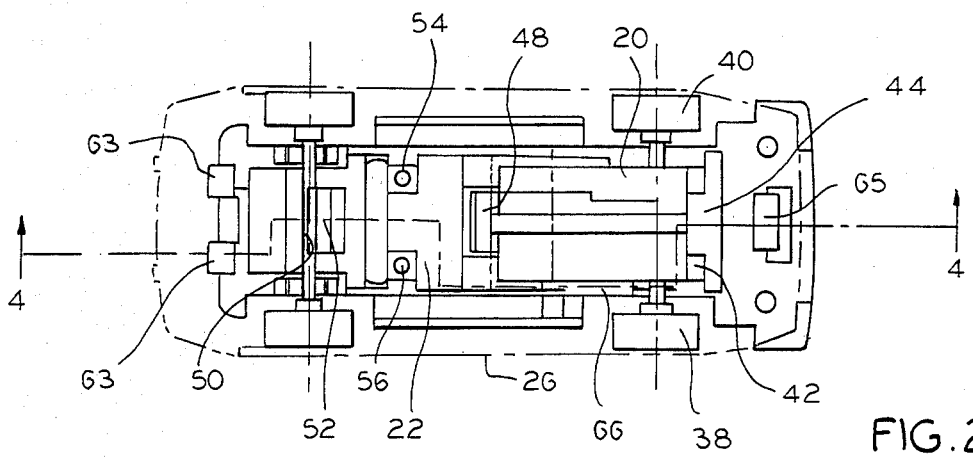
FIG. 2 is a top plan view of the inventive toggle-linkage system mounted on a chassis.
Figure 3:
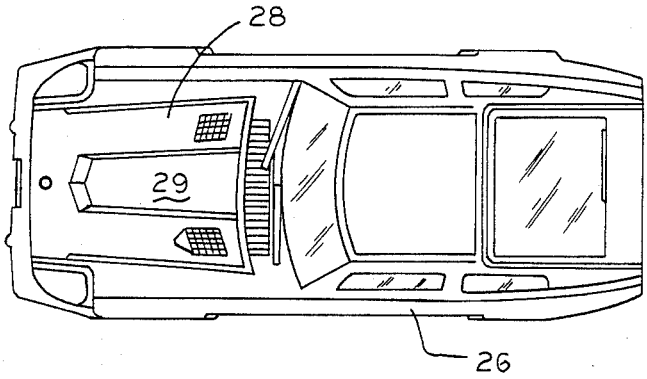
FIG. 3 is a top plan view of the toy vehicle where a body panel or other suitable part (here the hood) is used to release the energy stored in a spring and thereby propel the vehicle.

FIG. 1 includes an exploded view of the major subassemblies of the toy vehicle which are: a gear box 20 and a trigger part 22 which together form the toggle-linkage system, a chassis 24, and a body 26. The body 26 has the hood 29 outlined in a heavy inked line 28 to show that it is hinged at the front to provide an energy release control panel.

The gear box 20 may take any suitable form, which, for present purposes, might be viewed as being somewhat similar to the gear box shown in the Asano U.S. Pat. No. 4,077,156 or the Wyrick U.S. Pat. No. 2,182,529. In general, the gear box 20 contains a gear train which extends from an axle 30 to a clock spring 32. A movable pinion gear 33 is mounted on a shaft 34 which is free to move back and forth between the limits set by an elliptical or elongated hole 36. When shaft 34 is in one end (here the upper end) of the hole 36, the gear train is connected to axle 30 and wheels 38, 40 so that the vehicle is driven forward. When shaft 34 is in the other end (here the lower end) of hole 36, the gear train is connected to axle 30 in a manner which winds the spring 32 and stores energy when the vehicle is pushed backward. In short, the gear train is a transmission and the pinion is a reversing gear in that transmission.

Therefore, if the shaft 34 is trapped in one end (here the lower end) of hole 36, the gear train is locked in a spring winding or energy storage position. If shaft 34 is free to move into the other (upper) end of hole 36, the energy of the spring is released to propel the vehicle.

The rear side of gear box 20 has a step 42 which may be captured under a tab 44 integrally formed on the chassis 24. The front side of the gear box 20 also has a step 46 which engages edges 70, 72 on the trigger part 22. Step 46 also engages a limit stop 48, integrally formed on the chassis 24 to limit the upwardly travel of the gear box 20. The trigger part 22 has arms 49 which embrace the gear box 20 to stabilize the toggle-linkage against lateral movement.

The forward end of trigger part 22 has an aperture 50 which fits over and is held downwardly by a latch 52 integrally formed on chassis 24. There are two upstanding posts 54, 56 which fit into notches 58, 60 on the trigger part 22, in order to hold it in alignment. Thus, the trigger part 22 is free to move up and down within the limits provided by the floor of chassis 24 and limit stop 48. The remainder of the embossments on chassis 24 are provided for aligning the positions of the body shell 26 and the front axle 62 over the chassis 24. The front of the body shell is captured by hooks 63, after which the back of the body shell snaps down and over detent 65.

Figure 5:
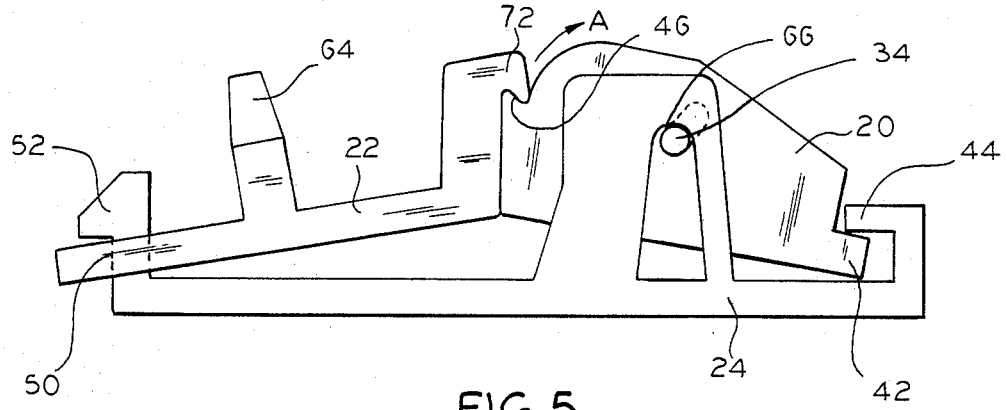
FIG. 5 shows the toggle-linkage in a first over-center position which locks the gear box and the energy stored in a spring.

The trigger part 22 has an upstanding part 64 integrally formed thereon which raises to a height that slightly raises hood panel 29, when the toggle-linkage is locked in an energy storage condition (see FIG. 5). The height of upstanding part 64 is such that, when the toggle-linkage is pushed down (see FIG. 6) to the energy release condition, the hood 29 fits smoothly against the body.

Figure 4:
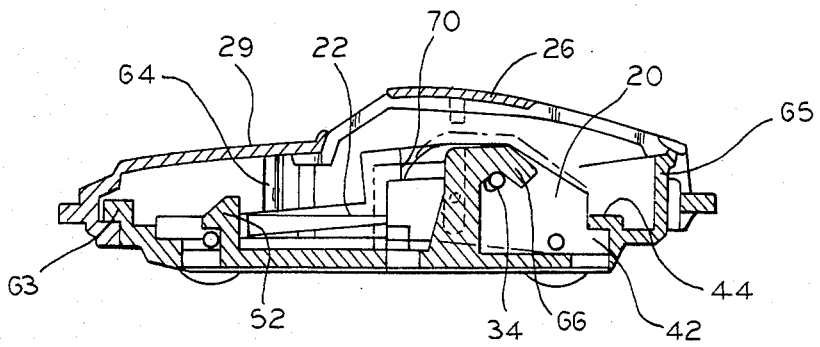
FIG. 4 is a cross-sectional view taken along line 4—4 of FIG. 2 to show the toggle-linkage mounted in the vehicle.

Integrally formed on the chassis 24 is an upstanding power locking hook means 66 which rises to a level that pulls the shaft 34 into the energy locked position, against the lower end of slot 36, while the gear box is raised to the level where step 46 bears against limit stop 48. When the gear box 20 is resting against the floor of chassis 24, the power locking hook means 66 allows the shaft 34 to escape to the upper end of the slot 36, which releases the energy stored in the clock spring 32. This gear box response to the toggle action is seen in FIG. 4 where the lower position of the gear box 20 is shown by solid lines and the raised position is seen by dot-dashed lines.

Figure 6:
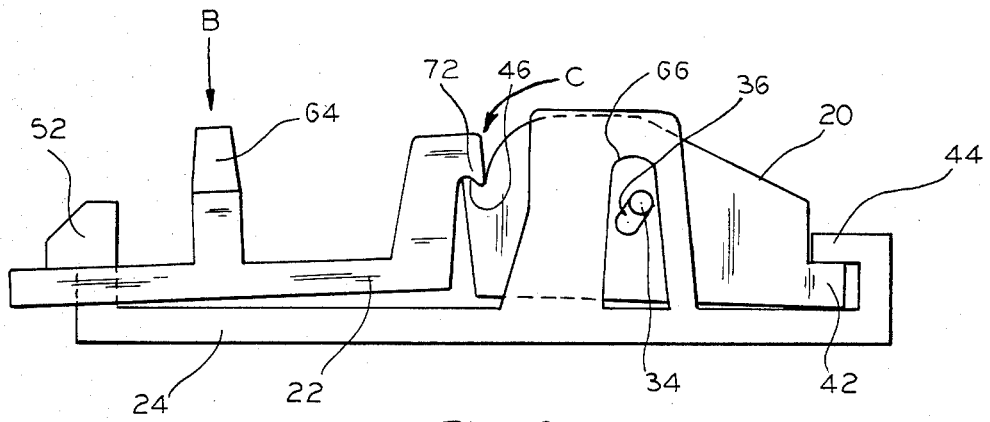
FIG. 6 shows the toggle-linkage in a second over-center position which unlocks the gear box and releases the energy stored in the spring.

In greater detail, FIGS. 5 and 6 show the two over-center positions of the toggle-linkage. One end of the trigger lever 22 is hooked under hook 52 near the front end of the chassis 24. As shown in FIG. 5, the clock spring 32 has been wound by moving the vehicle backward. Therefore, because the vehicle is rolled in a backward direction, tension in the clock spring urges the gear box 20 to tip upwardly in direction A. The tipping occurs because the back step 42 on gear box 20 rocks against a fulcrum formed by the tab 44 on the chassis 24. With the clock spring 32 urging the gear box upwardly in direction A, the shaft 34 is captured in the lower end of slot 36 by the hook 66. Thus, the pinion 33 places the gear train in a condition which responds to backward motion in order to wind the clock spring.

To release the energy stored in the clock spring 32, the hood of the automobile is pushed down, thereby pressing post 64 downwardly in direction B (FIG. 6) against the upstanding post 64. As the trigger part 22 moves downwardly in direction B, a pair of its edges 70, 72 press down on step 46 of the front of gear box 20. The gear box rocks in direction C.

As the gear box 20 moved downwardly, hook 66 is at a level which is above the upper end of the slot 36, thus allowing the pinion gear on shaft 34 to move upwardly. This pinion gear movement shifts the gears and enables the gear train in box 20 to be driven in a direction which is reversed to the direction in which the gear train moves when the vehicle is rolled backward. That reverse gear train movement is under the urging of the clock spring 32. Also, the release of the clock spring, through the gear train, relieves the bias which caused the toggle-linkage to move over center, as shown in FIG. 5.

When the clock spring runs down and loses its stored energy, the toggle-linkage remains in the energy release condition seen in FIG. 6.

When the vehicle is next rolled backward, energy is again stored in the clock spring 32. The toggle-linkage returns to the cocked position of FIG. 5. The gear train is again locked by the capture of the pinion shaft at the lower end of slot 36, until part 64 is next pushed in direction B (FIG. 6).

Figure 7:
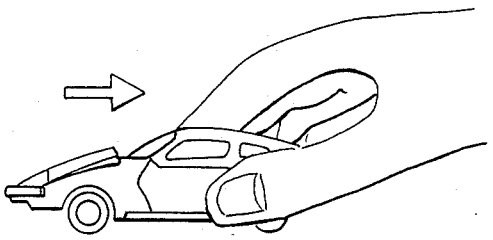
FIG. 7 shows the toy vehicle being rolled backward, to store energy.
Figure 8:
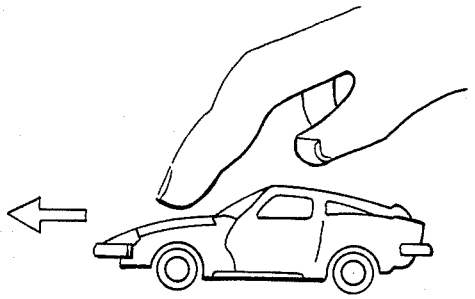
FIG. 8 shows the release of energy stored in the vehicle by a touch upon the hood.

The operating sequence is seen in FIGS. 7, 8. The vehicle is rolled backward as seen in FIG. 7. Then, the vehicle may be left indefinitely in the wound up condition. When the child wants the vehicle to run forward, he pushes down on hood 29 (FIG. 8). That flips the toggle-linkage from the FIG. 5 position to the FIG. 6 position, and the vehicle moves forward under the urging of the clock spring 32.

Those who are skilled in the art will readily perceive how to modify the invention. Therefore, the appended claims are to be construed to cover all equivalent structures which fall within the true scope and spirit of the invention.

The claimed invention is:

1. A toy vehicle having toggle-linkage means comprising a gear box containing a spring and a trigger lever arm, said gear box having a first end pivotally attached onto said vehicle at a particular point, said trigger lever arm having one end pivotally attached to said vehicle at a different point which is remote from said particular point, a second end of said gear box engaging another end of said trigger lever arm, the relative lengths of said gear box and trigger lever arm being such that said toggle-linkage may move back and forth between two over center positions, said spring urging said toggle-linkage to one of said two over center positions when said spring is wound, means responsive to backward motion of said vehicle on a support surface while said toggle-linkage is in said one of said positions for storing energy in said spring, and control means for applying a force to said toggle-linkage for moving said linkage to the other of said two over center positions, said gear box being coupled to drive said vehicle in a forward direction responsive to said toggle-linkage in said other over center position, whereby said gear box winds said spring responsive to a rotation of gears in said gear box in one direction and drives said vehicle on a support surface responsive to rotation of the gears in said gear box in an opposite direction with an unwinding of said spring.

2. The toy vehicle of claim 1 wherein said gear box contains a movable pinion gear which reverses the effective rotational direction of said gear box, and means responsive to movement of the toggle-linkage between said over center position for moving said pinion gear.

3. The toy vehicle of claim 2 and hook means integrally formed on said vehicle for controlling said movement of said pinion gear responsive to the movement of said toggle-linkage between said two over center positions.

4. The toy vehicle of claim 3 and hinged body panel means on said vehicle, said control means applying said force to said toggle-linkage responsive to movement of said body panel.

5. A toy wheeled vehicle comprising toggle-linkage means, spring means, transmission means with a reverse gear controlled by said toggle-linkage and said spring means; means responsive to turning at least one wheel on said vehicle when said vehicle is rolled backward on a supporting surface for transmitting energy from said wheel through said transmission and automatically operating said toggle-linkage for storing and locking energy in said spring, means responsive to a manipulation of said toggle-linkage for unlocking and releasing said energy stored in said spring, said release of said energy engaging said reverse gear, and means responsive to said release of said energy stored in said spring and to said engaging said reverse gear for turning at least said one wheel and propelling said vehicle in a forward direction on a supporting surface.

6. The toy of claim 5 wherein spring tension caused by said energy stored in said spring urges said toggle-linkage to said operated position.

7. The toy of claim 6 and means integrally formed on said vehicle in a position relative to the position of said toggle-linkage in said operated position for urging said reversing gear to an energy storage position responsive to turning said one wheel when said vehicle is rolled backward.

8. The toy of claim 7 wherein said vehicle comprises a body part which is manually movable to move said toggle-linkage away from said operated position for urging said reversing gear to an energy release position.

9. The toy of claim 8 wherein said body part is a hood of said vehicle.

* * * * *